US009410541B2

(12) United States Patent
Klentzman

(10) Patent No.: US 9,410,541 B2
(45) Date of Patent: Aug. 9, 2016

(54) LIQUID SAMPLE PUMP WITH INTEGRAL SELF-CLEANING FILTER ELEMENT

(71) Applicant: Welker, Inc., Sugar Land, TX (US)

(72) Inventor: James T. Klentzman, Richmond, TX (US)

(73) Assignee: Welker, Inc., Sugar Land, TX (US)

( * ) Notice: Subject to any disclaimer, the term of this patent is extended or adjusted under 35 U.S.C. 154(b) by 223 days.

(21) Appl. No.: 14/155,341

(22) Filed: Jan. 14, 2014

(65) Prior Publication Data

US 2015/0198157 A1 Jul. 16, 2015

(51) Int. Cl.
*F04B 53/20* (2006.01)
*F04B 13/00* (2006.01)

(52) U.S. Cl.
CPC ..... *F04B 13/00* (2013.01)

(58) Field of Classification Search
CPC ..... F04B 13/00; F04B 53/20; F04B 7/02; G01N 1/2035; G01N 1/2042; G01N 2001/2057; G01N 1/2247; G01N 2001/2267; G01N 2001/227
USPC ..... 73/863.23
See application file for complete search history.

(56) References Cited

U.S. PATENT DOCUMENTS 2,726,548 A 12/1955 Van Der List
3,400,575 A 9/1968 Madden
3,598,238 A 8/1971 Collins, Jr.
4,533,471 A 8/1985 Collins et al.
4,628,750 A * 12/1986 Welker ..... G01N 1/2035 73/863.71
4,693,815 A 9/1987 Collins et al.
4,727,758 A 3/1988 Murdock
4,928,536 A * 5/1990 Welker ..... G01N 1/14 73/863.83
5,074,154 A 12/1991 Allen et al.
5,092,742 A 3/1992 Allen et al.
5,191,801 A 3/1993 Allen et al.
5,423,228 A 6/1995 Budd et al.
5,522,708 A 6/1996 Nimberger
5,641,894 A 6/1997 Hosokawa
5,736,654 A 4/1998 Dubois
RE35,824 E * 6/1998 Welker ..... G01N 1/14 73/863.83

(Continued)

OTHER PUBLICATIONS

YZ Systems, Inc., Light Liquid Sampler, System Support Manual PNR-2S-1.5, 3, 5P-0A, Version 01182002, Conroe, Texas; 2002.

(Continued)

*Primary Examiner* — Freddie Kirkland, III
(74) *Attorney, Agent, or Firm* — Husch Blackwell LLP

(57) ABSTRACT

In combination, a liquid sample pump and an integral self-cleaning filter element will elongate the maintenance interval for the pump which saves on time and labor costs. The filter element itself is small, economical to make and forms an integral part of the liquid sample pump. A flow passageway continuously directs turbulent liquid to the underside of the filter element to sweep debris from the filter element and return such debris to the pipeline. When it is necessary to service the liquid sample pump, it is quick and easy to remove and replace the filter element, which also saves on time and labor costs. A bleed valve assembly allows air to be bled from the sample pump prior to operation, enhancing seal life. An optional muffler assembly excludes insects from the inside of the sample pump, again elongating maintenance intervals. An optional return valve assembly allows unused sample to be returned to the pipeline, thus benefitting the environment. The filter element may be formed from a metal screen or a sintered metal disk.

15 Claims, 13 Drawing Sheets

(56) References Cited

U.S. PATENT DOCUMENTS

| | | | | |
|---|---|---|---|---|
| 5,945,611 | A * | 8/1999 | Welker | G01N 1/2035 73/863.71 |
| 6,076,410 | A | 6/2000 | Renslow | |
| 6,085,777 | A | 7/2000 | Welker | |
| 6,338,359 | B1 | 1/2002 | Welker | |
| 6,357,304 | B1 * | 3/2002 | Mayeaux | G01N 1/2035 73/863.12 |
| 6,400,575 | B1 | 6/2002 | Brown et al. | |
| 6,761,757 | B2 | 7/2004 | Welker | |
| 6,764,536 | B2 * | 7/2004 | Welker | G01N 1/2247 55/417 |
| 7,540,206 | B2 | 6/2009 | Gibson et al. | |
| 8,056,400 | B2 | 11/2011 | Reintjes et al. | |

OTHER PUBLICATIONS

Collins Products Company, Collins Products Company 2011 Catalog, Livingston, Texas; 2011.

Welker, Probe Mounted Liquid Eliminator, Oct. 4, 2011.

* cited by examiner 20
54
66
64
52
56
58
30
34
42
62
60
24
26
22
36
46
48
44
252
32
114
104

100
110
102
118
118
106
108
192
112
194

152
88
116
86
90
156
172
84
92
96
82
126
94
128
PIPELINE 70
174
155
151
154

20
30
34
60
24
26
22
28
32
252
36
100
68
192
108
276
194
152
86
90
116
156
172
58
70
84
92
88
160
96
82
94
128
PIPELINE 70
174
155
151
154

190

20
30
34
24
26
22
28
32
252
36
100
102
108
68

152
116
194
192
156
172
160
128
PIPELINE 70
174
155
151
154

LIQUID SAMPLE PUMP WITH INTEGRAL SELF-CLEANING FILTER ELEMENT

DISCUSSION OF THE PRIOR ART

Samplers are known, such as the Light Liquid Sampler produced by YZ Systems, Inc. of 3101 Pollok Dr., Conroe, Tex. 77303. See, for example the YZ System Support Manual for the PNR-2s-1.5, 3,5P-0A. Some prior art liquid products have filter elements that get clogged by debris entrained in the liquid. Some prior art liquid samplers have dead space in the sample mechanism. Some prior art products do not have a continuously flowing loop of liquid passing through the sampler. The present invention has a loop of liquid continuously flowing through the sampler, has minimal dead space and an integral self-cleaning filter element. A continuously flowing loop of liquid through the sampler is sometimes called a "hot loop" in the industry.

Collins Products Company of Livingston, Tex., sells the prior art Swirlklean™ filter as shown in the 2011 Catalog on page 3. The Swirlklean filter element is a heavy, expensive, stand-alone filter element often used in refineries that costs from about $360 to about $900 or more. The Swirlklean filter is sometimes installed upstream of and separate from a sample pump. This filter element uses a bypass stream that enters the housing tangentially to a drum-like filter element; the circular current around the filter element is intended to keep debris washed off the drum-like filter element. The Swirlklean filter uses a continuously flowing stream, but it has a different structure. The Swirlklean filter is not integral with a sample pump, like the present invention. The cost of a Swirlklean filter and prior art sample pump together are more expensive than the present invention and more difficult to install and maintain. Collins Products Company is believed to own at least the following patents on self-cleaning filter systems: U.S. Pat. Nos. 4,533,471; 3,598,238; 4,533,471 and 4,693,815

A search located the following patents owned by PGI International of Houston, Tex.: U.S. Pat. Nos. 5,522,708; 5,191,801 and 5,092,742. The '742 Patent provides a strainer between the process line and the sampling pump to prevent debris from entering the pump. However, the strainer does not extend across the entire cross-section of the hot loop path, so all fluid continually flowing through the hot loop and returning to the process line is not cleaned. A purge line within the manifold has its inlet closely adjacent the strainer to automatically clean the strainer during conventional purging of the sample vessel. The present invention has continuous cleaning of the filter element caused by the continuously flowing loop; unlike the '742 Patent which only cleans the strainer during periodic purging of the sample vessel. The continuous cleaning of the present invention is better than periodic cleaning.

The search also located the following patents: U.S. Pat. Nos. 2,726,548; 6,400,575; 4,727,758; 5,423,228; 5,641,894; 5,736,654; 7,540,206; 6,076,410; 8,056,400. Many of these patents use periodic back flush techniques similar to swimming pool filter elements. The continuous cleaning of the present invention is better than periodic back flushing techniques.

Welker, Inc., formerly known as Welker Engineering Company of Sugar Land, Tex., the assignee of the present invention, owns several relevant patents as follows: U.S. Pat. Nos. 6,338,359; 6,761,757; and 6,764,536 (hereinafter '536 Patent). The '536 Patent discloses an apparatus that functions on a multiphase fluid that includes both gas and liquids. The present invention functions only on liquids, not multiphase fluids. Natural gas, even though generally referred to as a gas, when transported, often contains liquid and gas hydrocarbon components. The "liquid eliminator" of the '536 Patent is intended to separate the liquid component from the gaseous component in a natural gas stream because many instruments will not accept the liquid component and still function properly, such as a gas chromatograph. The porous membrane 41, described in the '536 Patent, forms gas flow channels to allow gas to pass through the membrane. These flow channels are so small that they exclude all liquids. The present invention functions only on liquids. Therefore, the filter element of the present invention cannot be substituted for the filter element in the '536 Patent, and the filter element disclosed in the '536 Patent cannot be used in lieu of the filter element in the present invention.

The porous membrane described in the '536 Patent is supported by an insert which obstructs the center portion of the porous membrane from contact with the inlet stream. Therefore, a substantial portion of the filter element is not in contact with the inlet stream because of the insert. Therefore, the inlet stream is incapable of sweeping debris from a substantial portion of the porous membrane. Without the insert, the flimsy porous membrane may fail.

SUMMARY OF THE PRESENT INVENTION

Separate filters are sometimes placed upstream of prior art sample pumps to prevent debris entrained in the liquid from entering the pump. Separate upstream filters may be heavy, expensive, and in combination with a sample pump, are more difficult to install and maintain. The present invention utilizes a small, light-weight, integral filter element in the sample pump. The small, light-weight, integral filter element is often less expensive than separate upstream filters. The threaded version of the present invention weighs about 16 U.S. pounds and retails for approximately $4,300. The threaded version of the present invention is easy to install because it simply screws into a thread-o-let in the pipeline.

The flanged version of the present invention weighs about 26 U.S. pounds and retails for approximately $4,900. The flanged version connects to a mating flange on the pipeline with a plurality of nuts and bolts, as is well known in the industry. The flanged version is also easy and quick to install. The sintered metal filter element retails for about $15 and the metal mesh filter element retails for about $5.

Liquids flowing through a pipeline need to be sampled for various reasons. In the present invention, a loop of liquid continuously flows through a passageway in the sample pump and returns to the pipeline, assuring that fresh sample is taken when the sample pump strokes, or takes a sample. In such continuously flowing loops of liquid, debris may clog the filter element, especially in a sample pump. A clogged filter element requires unwanted disassembly of the sample pump, removal and replacement of the filter element and reassembly of the sample pump, which is time consuming, expensive and stops the sample process during the unwanted maintenance.

In the present sample pump, the liquid flowing through the continuous loop is turbulent, not laminar. This liquid passes from the pipeline, up into the pitot probe, makes a 90° turn and passes through a horizontal inlet passageway, past the open inlet on/off valve, through an angled inlet passageway to an agitation chamber below the filter element, through an angled outlet passageway, past the open outlet on/off valve, through a horizontal outlet passageway, makes a 90° turn, passes through an outlet passageway and is discharged back into the pipeline. Because of the twists and turns of the tortuous passageway through the present sample pump, the liquid becomes turbulent, and when it reaches the agitation chamber, it sweeps debris from the bottom surface of the filter element and back into the pipeline. The turbulent liquid in the agitation chamber self-cleans the filter element. The exact shape of the flow passageway is not critical; the fact that the liquid becomes turbulent as it passes through the tortuous passageway and is turbulent below the filter element is necessary for the self-cleaning action.

Even with a self-cleaning filter, it will eventually be necessary to replace the filter element of the present invention; when maintenance is necessary, the integral self-cleaning filter is quick and easy to service. Two on/off valves are closed, which stops the flow of liquid through the hot loop; four nuts are removed from the lower part of the pump, allowing fast and easy disassembly of the sample pump and quick replacement of the filter element. If warranted, the seal assembly on the lower portion of the piston rod may also be replaced.

The cartridge type check valves on this sample pump are also easy to maintain and may be checked using air pressure. Several different types of replaceable filter elements may be used in this sample pump, including a sintered metal filter element or a metal mesh filter element. The sintered metal filter element may be used with natural gas liquids such as ethane, propane, butane, etc. The metal mesh filter element may be used with light crude oil or condensate separated from natural gas. A bleed valve may be provided to drain air from the variable volume sample chamber; further, when air is bled from the variable volume sample chamber, liquid fills the chamber and acts as a lubricant to prolong the life of the seal assembly on the lower portion of the elongate piston rod. An optional return valve allows unused sample to be returned to the pipeline, thus benefitting the environment.

DETAILED DESCRIPTION OF THE INVENTION

Figures 1, 7, 8:
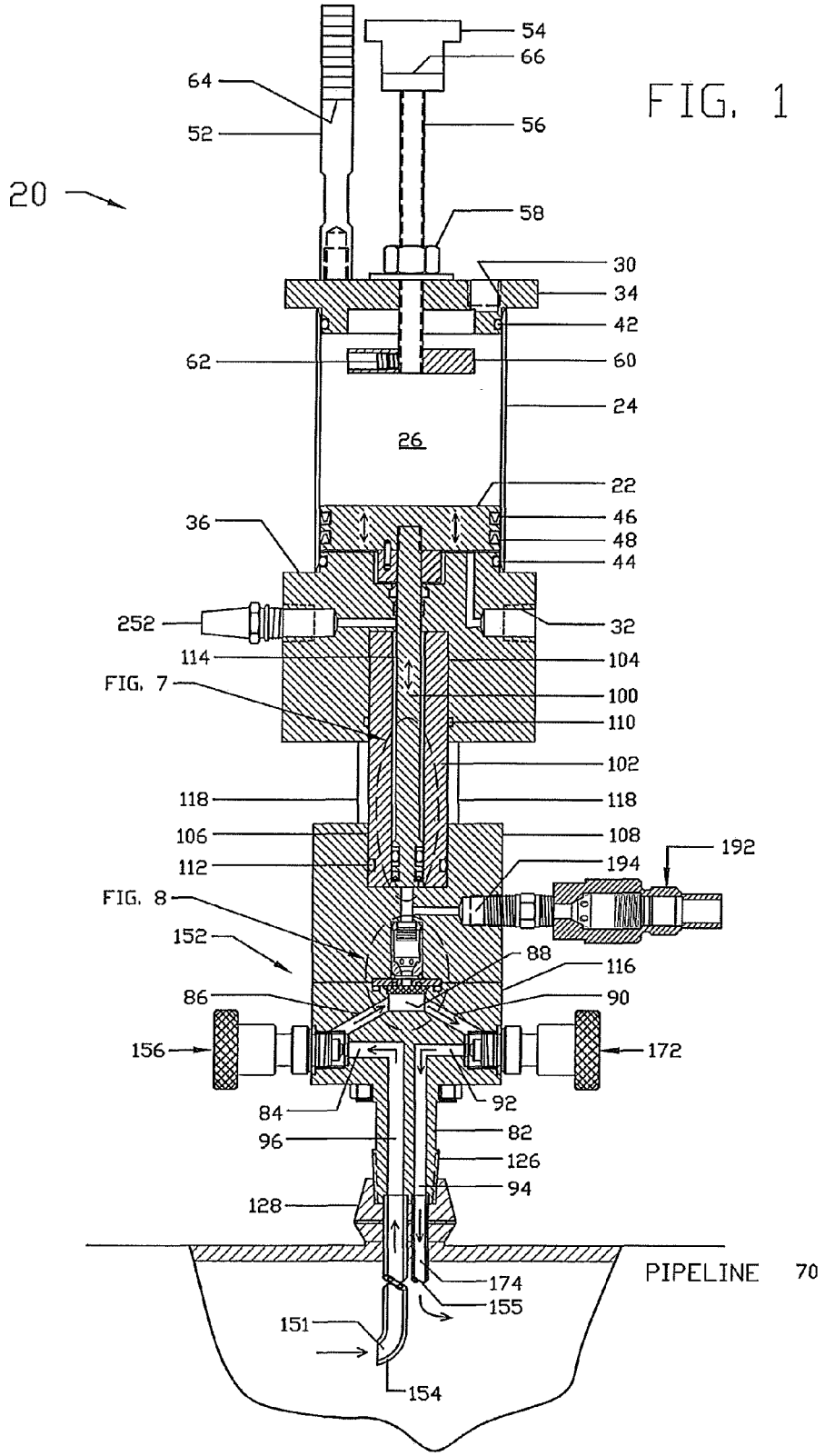
FIG. 1 is a section view of the sample pump with integral self-cleaning filter positioned in a pipeline. A sintered metal filter element is shown in FIG. 1. For illustrative purposes, the internal structure of the sample pump has been rotated 90° in this view relative to the pitot probe, to better understand the apparatus.
FIG. 7 is an enlargement of the sealing assembly on the end of the piston rod.
FIG. 8 is an enlargement of the inlet check valve assembly in the closed position with a sintered metal filter element. The turbulent liquid is indicated by the swirling lines.
Figure 2:
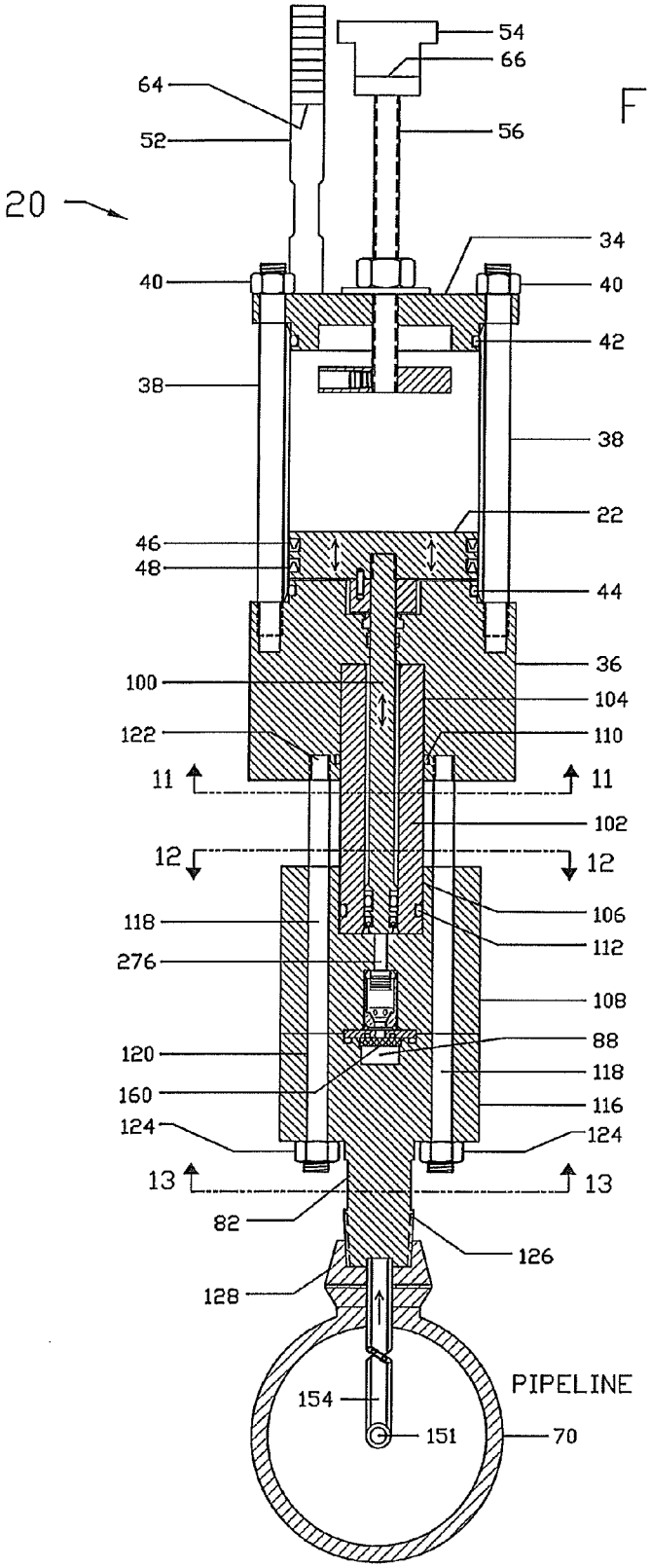
FIG. 2 is a section view of the sample pump with integral self-cleaning filter element. A sintered metal filter element is shown in FIG. 2.

The word "up" as used herein means away from the pipeline 70 and the word "down" as used herein means toward the pipeline 70. Referring to FIGS. 1 and 2, the sample pump with integral self-cleaning filter element is generally identified by the numeral 20. Solely for illustrative purposes, the structure of the sample pump in FIG. 1 has been rotated 90° counterclockwise relative to the pitot probe, when viewed from above. FIG. 2 has been rotated clockwise relative to the pitot probe, when viewed from above, to better illustrate the tie rods 38 and 118.

A means for stroking a power piston up and down includes the power piston 22 slideably located in an upper cylinder 24, which divides the upper cylinder into an upper chamber 26 and a lower chamber 28, better seen in subsequent figures. The upper chamber 26 is in fluid communication with the upper in/out port 30 and the lower chamber 28 is in fluid communication with the lower in/out port 32.

Referring back to FIG. 1, an upper end cap 34 seals against the upper cylinder 24 by the o-ring 42; a body 36 seals against the upper cylinder 24 by the o-ring 44. The upper end cap 34, the upper cylinder 24 and the body 36 are held together by a plurality of tie rods 38, better seen in FIG. 2, secured by a plurality of nuts 40. The power piston 22 seals against the inside circumference of the upper cylinder 24 by an upper PolyPak® seal assembly 46 and a lower PolyPak® seal assembly 48. The PolyPak® seal assembly 46 and 48, model number 1250-0250 may be formed from Viton® polymer and are available from Parker whose headquarters is in Salt Lake City, Utah.

A means for adjusting the volume of the variable volume sample chamber 68, better seen in subsequent figures, includes the following: a vertical measurement bar 52 secured to the upper end cap 34, a knob 54 permanently secured to a threaded shaft 56 which threadably engages a nut 58 permanently secured to the upper end cap 34, and a piston stop 60 secured to the threaded shaft by a set screw 62. The upper end cap 34 is removably connected to the body 36. Volumetric measurement indicia 64 may be inscribed on the vertical measurement bar 52 such as: 0 cc, lee, 2 cc, 3 cc, 4 cc, 5 cc, 6 cc, 7 cc and 8 cc. The sample volume range may vary depending on the application. A measurement line 66 is inscribed on the knob 54. The knob is rotated up or down until the measurement line 66 aligns with the selected volumetric measurement indicia 64. The piston stop 60 then prevents the power piston 22 from rising any further than desired, thus defining the volume of sample drawn into the variable volume sample chamber 68, better seen in subsequent figures.

An elongate piston rod 100 is secured to the power piston 22 so the elongate piston rod moves up and down with the travel of the power piston 22. A lower cylinder 102 surrounds a portion of the elongate piston rod 100. The lower cylinder 102 defines an inside circumferential surface 103, best seen in FIG. 7. A bore 104 is formed in the body 36 and is sized and arranged to receive one end of the lower cylinder 102. A bore 106 is formed in the housing 108 and is sized and arranged to receive a portion of the other end of the lower cylinder 102. One end of the lower cylinder 102 is sealed against the body 36 by the upper o-ring 110; the other end of the lower cylinder 102 is sealed against the housing by the lower o-ring 112. A central bore 114 is formed in the center of the lower cylinder and is sized and arranged to receive a portion of the elongate piston rod 100.

Referring now to FIG. 2, a plurality of tie rods 118, pass through elongate bores 120 in the lower end cap 116 and the housing 108 to thread into threaded apertures 122 in the body 36. A plurality of nuts 124 threadably engage the exposed threaded ends of the tie rods 118 to secure the body 36 to the lower cylinder 102 to the housing 108 and to the lower end cap 116. Removal of the nuts 124 allows quick and easy disassembly of the lower section of the liquid sample pump 20, if it is necessary to service the apparatus. The lower end cap 116 defines a neck 126 which threadably engages a thread-o-let 128 welded to the pipeline 70. Wrench flats 82 are formed above the neck 126. As indicated by the flow arrow, liquid is flowing through the pipeline 70.

Figures 3, 4:
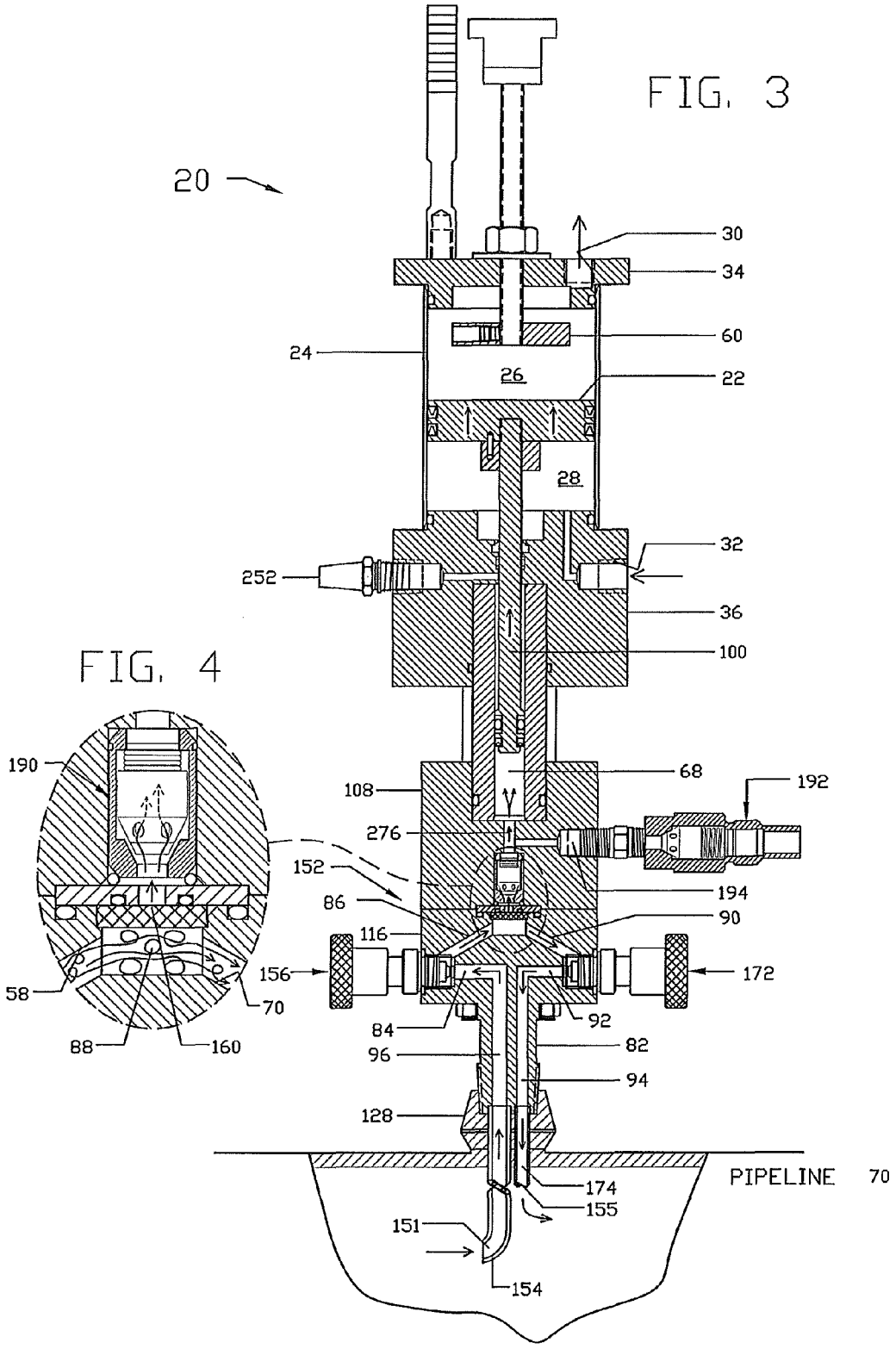
FIG. 3 is a section view of the sample pump with integral self-cleaning filter similar to FIG. 1, except the power piston is moving upward, as indicated by the arrows, to allow a sample to be drawn into the variable volume sample chamber. A sintered metal filter element is shown in this figure.
FIG. 4 is an enlargement of the inlet cartridge check valve assembly in the open position.
Figures 5, 6, 8:
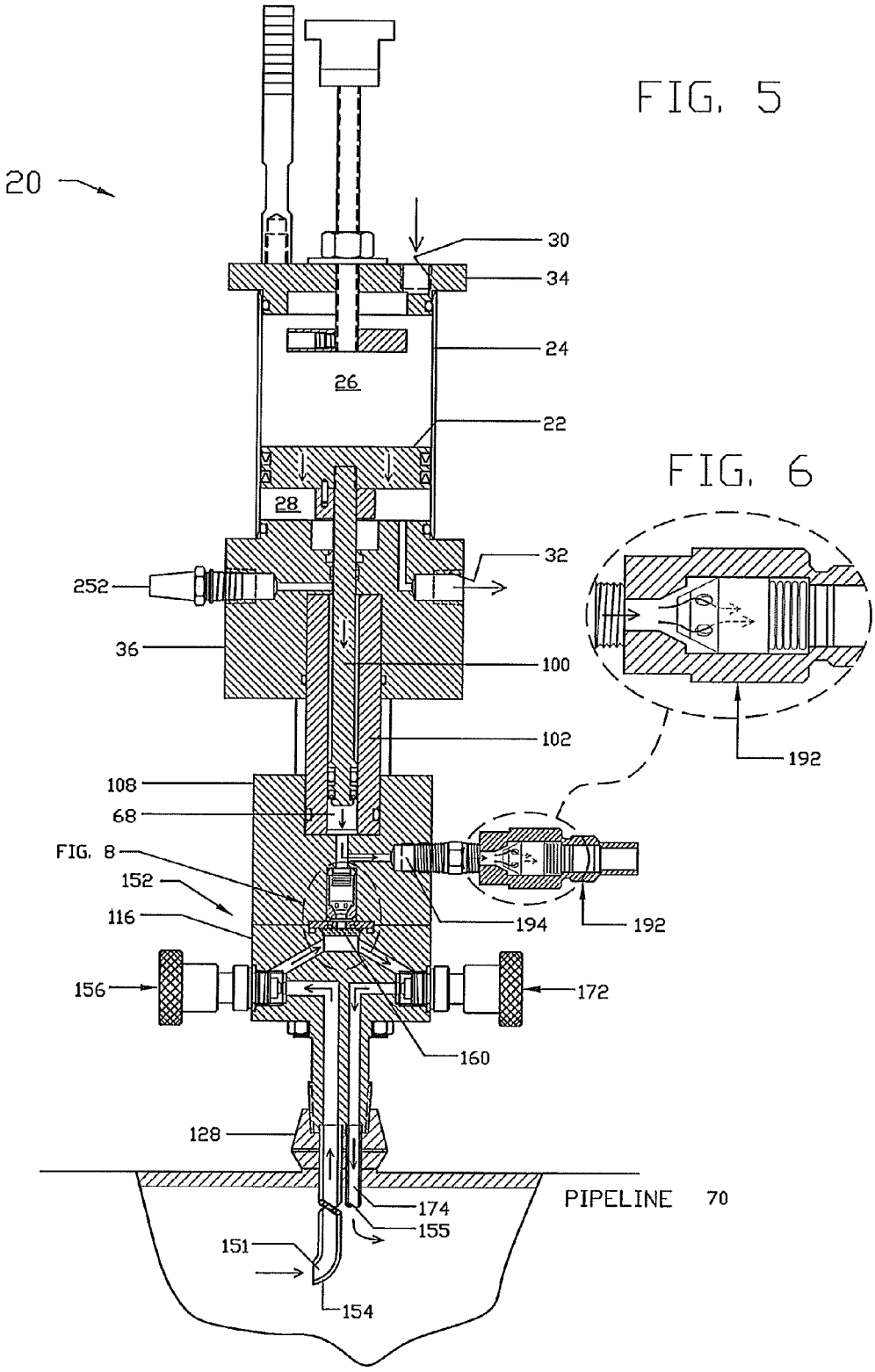
FIG. 5 is a section view of the sample pump with integral self-cleaning filter similar to FIG. 1, except the power piston is moving downward, as indicated by the arrows, to pump sample into the sample container.
FIG. 6 is an enlargement of the outlet cartridge check valve assembly in the open position.
Figure 7:
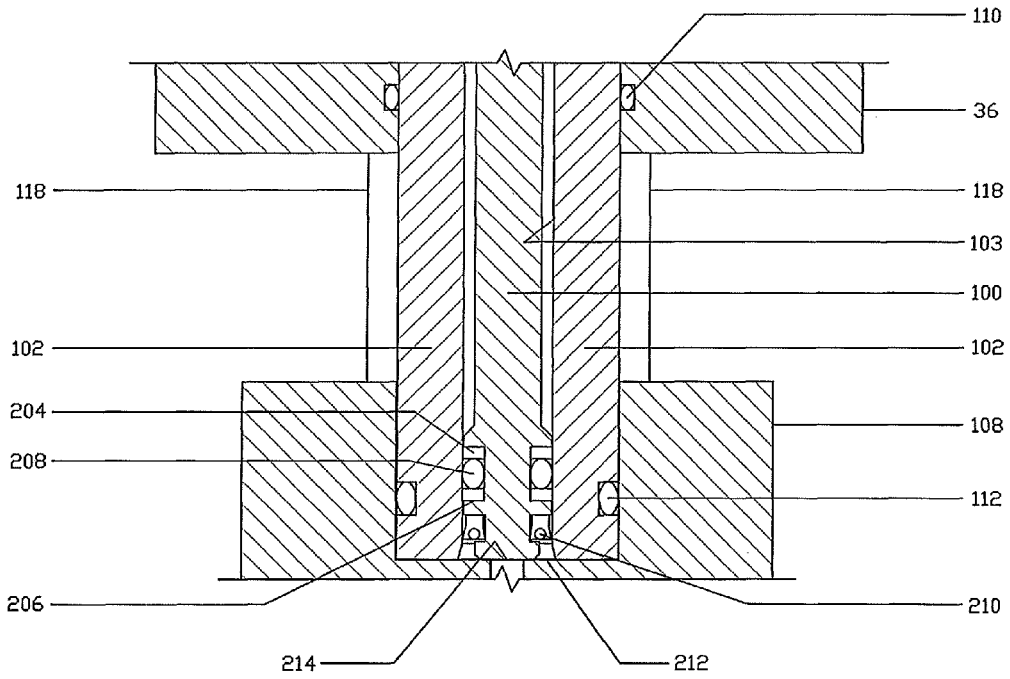
Figure 8:
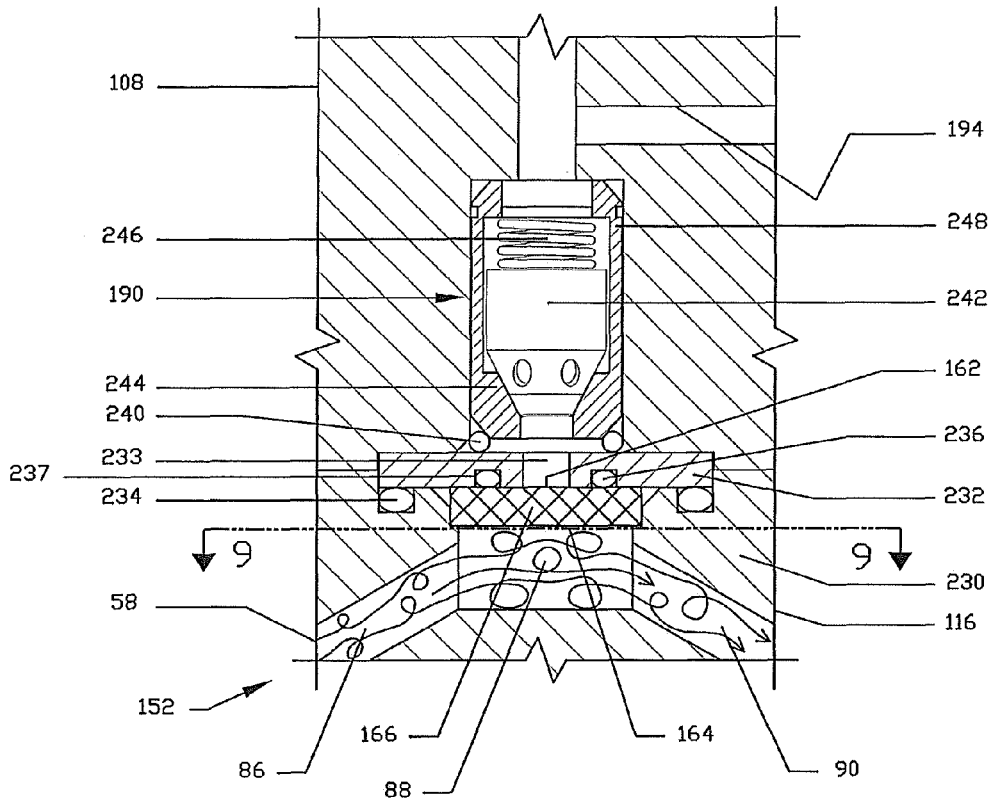

A continuous liquid flow passageway is generally identified by the numeral 152 and is also known as a "hot loop" in the industry. The straight flow arrows in FIGS. 1, 3 and 5 show the direction of flow through the continuous liquid flow passageway 152; however, the flow itself becomes turbulent as it passes through the tortuous passageway of the hot loop. The inlet 151 for this continuous liquid flow passageway 152 is a pitot tube 154 and the outlet 155 is a shorter tube 174 located downstream of the inlet. The inlet and the outlet for the continuous liquid flow passageway are both in fluid communication with the liquid flowing through the pipeline 70. The inlet and the outlet should be formed in the neck 126 of the present apparatus to facilitate installation and removal of the liquid sample pump 20 on the pipeline.

Referring back to FIG. 1, the liquid enters the pitot tube 154, travels through an up tube 96, makes a 90° turn and passes through a horizontal inlet passageway 84, past the inlet on/off valve assembly 156, through an angled inlet passageway 86 to an agitation chamber 88 below the self-cleaning filter element 160, through an angled outlet passageway 90, past the outlet on/off valve assembly 172, through a horizontal outlet passageway 92, makes a 90° turn, passes through a down tube 94 and is discharged back into the pipeline by the shorter tube 174. Because of the twists and turns of the tortuous passageway through the present liquid sample pump 20, the liquid becomes turbulent and when it reaches the agitation chamber, it sweeps debris from the bottom surface of the self-cleaning filter element 160, better seen in FIG. 2 and subsequent figures, and back into the pipeline 70. The turbulent liquid in the agitation chamber 88 self-cleans the filter element 160. The shape of the flow passageway is not critical; the fact that the liquid becomes turbulent before it passes below the filter element 160 in the agitation chamber 88 is necessary for the self-cleaning action.

Figure 16:
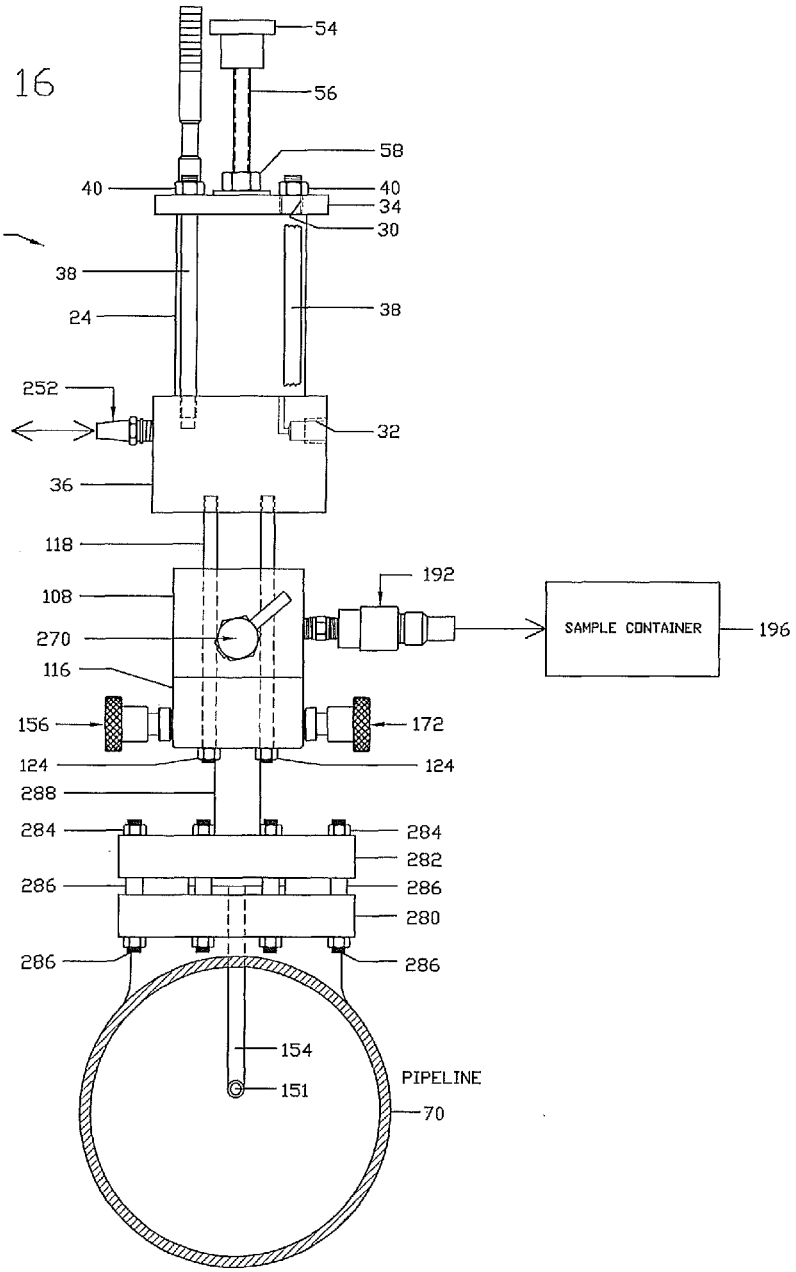
FIG. 16 is a section view of the sample pump with integral self-cleaning filter element. This version of the invention has a flange to connect to a mating flange on the pipeline using nuts and bolts. This is also an accurate view of the invention, unlike some of the prior figures that were for illustrative purposes.

Referring now to FIGS. 3 and 4, the liquid sample pump with integral self-cleaning filter element 20 is actuated to stroke up and draw sample from the pipeline 70 into the variable volume sample chamber 68 as indicated by the flow arrows. Referring now to FIG. 16, the upper in/out port 30 is connected by tubing 72 to a pneumatic/electric solenoid 74 which connects to a source 76 of pressurized air. The lower in/out port 32 is connected by tubing 78 to the pneumatic/electric solenoid 74. A control system 80, which can include an electronic flow measurement computer and/or a programmable logic controller and/or a distributed control system, is wired to the pneumatic/electric solenoid 74. When the control system 80 actuates the pneumatic/electric solenoid 74, pressurized air flows through the tubing 78 into the lower chamber 28, as best seen in FIG. 3, driving the power piston 22 up which expels air from the upper chamber 26, through the tubing 72 back to the pneumatic/electric solenoid 74. As the power piston 22 strokes up, it carries the elongate piston rod 100 up, as shown by the arrow, drawing liquid from the agitation chamber 88 through the self-cleaning filter element 160 past an inlet check valve assembly 190, which is shown in the open position in FIGS. 3 and 4. In FIG. 3, the outlet check valve assembly 192 is in the closed position. The power piston 22 moves up in the upper cylinder 24 until it hits the piston stop 60.

To reverse the direction of the power piston 22 as seen in FIG. 5, the control system 80 actuates the pneumatic/electric solenoid 74 in the opposite direction and pressurized air from the source 76 flows through the tubing 72 into the upper chamber 26 driving the power piston 22 down and air in the lower chamber 28 exits through the tubing 78 back to the pneumatic/electric solenoid 74. In this fashion, the power piston 22 is stroked down. Liquid passes from the variable volume sample chamber 68 through the sample outlet 194 as indicated by the arrows and past the outlet check valve assembly 192 to the sample container 196, as best seen in FIG. 16. In this manner the elongate piston rod 100 strokes down and bottoms in the variable volume sample chamber 68 as shown in FIG. 1.

To summarize, the elongate piston rod 100 begins a cycle at the bottom of the variable volume sample chamber 68, as better seen in FIG. 2. The elongate piston rod 100 then strokes up, as shown by the arrows in FIG. 3 until the power piston 22 hits the piston stop 60. Liquid is drawn into the variable volume sample chamber 68 during the up stroke of the elongate piston rod 100, as shown in FIG. 3. The elongate piston rod 100 then strokes down, as shown by the arrows in FIG. 5, until it bottoms in the variable volume sample chamber 68. Liquid is pumped from the variable volume sample chamber 68 into the sample container 196. The elongate piston rod 100 comes to rest at the bottom of the variable volume sample chamber 68, as better seen in FIG. 2. The liquid sample pump 20 is then ready to begin another stroke cycle.

Referring now to FIG. 7, a portion of the body 36 is shown at the top of the drawing and a portion of the housing 108 is shown at the bottom of the drawing. A lower o-ring 112 seals the housing 108 against the lower end of the lower cylinder 102. The lower cylinder defines an inside circumferential surface 103. Referring to the end of the elongate piston rod 100, a seal means includes a first wiper 204 and a second wiper 206 surround o-ring 208; at the end of the elongate piston rod 100 is a PolyPak seal assembly 210. This seal means engages the inside circumferential surface 103. The end 214 of the elongate piston rod 100 is touching the bottom 212 of the variable volume sample chamber 68, as better seen in FIGS. 3 and 5.

Referring now to FIG. 8, the inlet check valve assembly 190 is shown in enlarged format in the closed position. A metallic washer 232 with a central opening 233 sits on the upper surface 162 of the sintered metallic filter element 166 to hold the filter element in place. An o-ring 234 seals the metallic washer 232 against the lower end cap 116. Another o-ring 236 is positioned in a channel 237 formed in the lower side of the metallic washer 232 and seals against the sintered metallic filter element 166 and the metallic washer 232. As best seen in FIG. 8, the turbulent liquid flowing through the agitation chamber 88 of the continuous liquid flow passageway 152 sweeps against the lower surface 164 of the sintered metallic filter element 166 to remove debris from the lower surface 164.

A self-cleaning filter element 160 may be a sintered metal disk-shaped filter element 166 which is an off-the-shelf item from MOTT Corporation in Farmington, Conn.; the website is www.mottcorp.com. The sintered metallic filter element 166 may be about 0.625 inches in diameter and about 0.125 inches thick. MOTT calls this self-cleaning filter element a "porous metal media", 40 micron grade and may sometimes be referred to in the industry as a "sintered stone" filter element. Filter elements with 20, 60 or 100 micron grade may also be suitable in this invention, depending on the location, application and the amount of debris in the pipeline.

Figure 10:
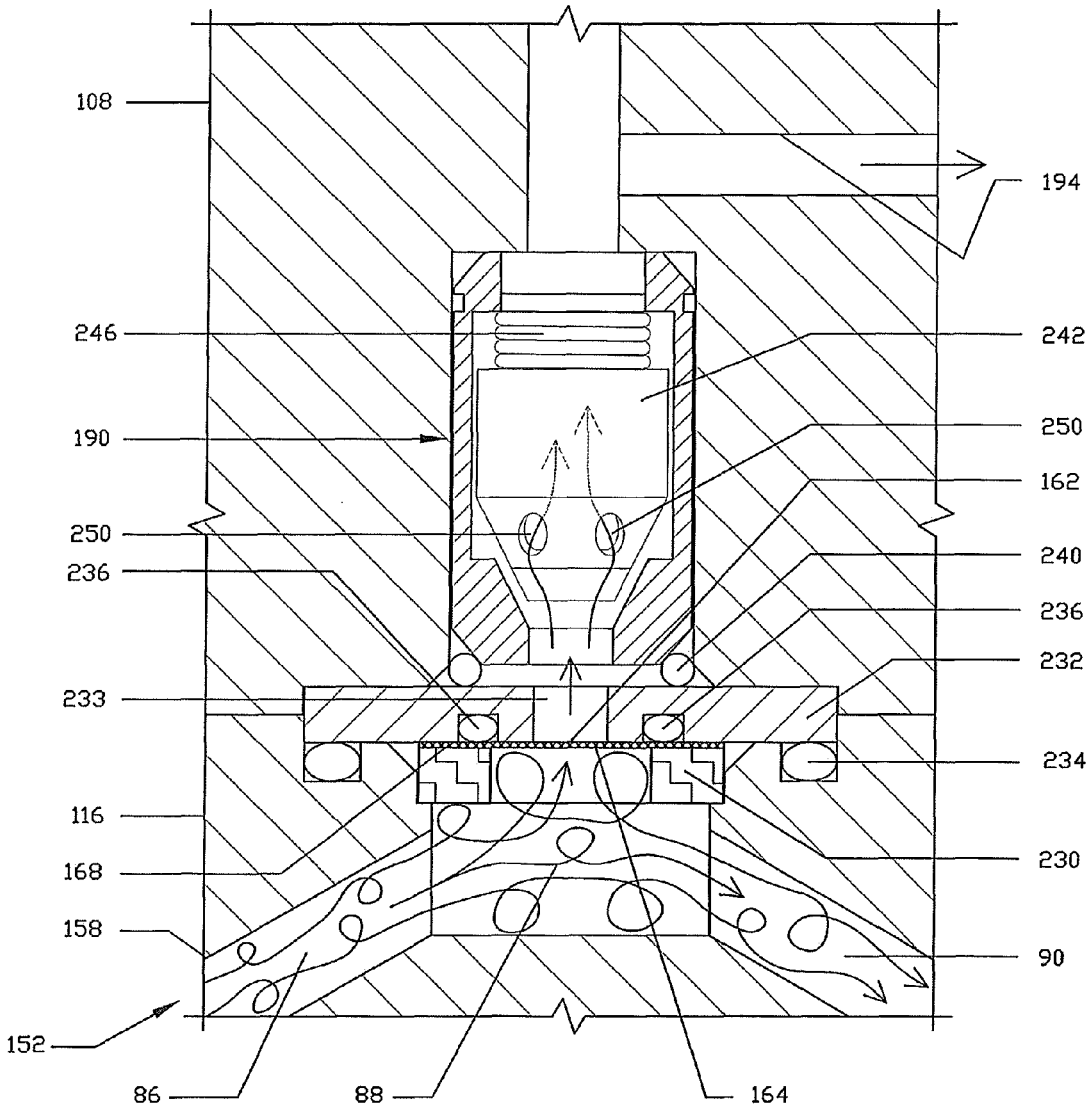
FIG. 10 is an enlargement of the inlet check valve assembly in the open position with a metal screen filter element.

The self-cleaning filter element 160 may, in the alternative, be formed from a disk-shaped metal mesh screen 168, as better seen in FIG. 10. The metal mesh is available from CPI Wire Cloth & Screen, Inc. located in Pearland, Tex.; the website is www.cpiwirecloth.com. The disk-shaped screen is about ⅝ inch in diameter, about 0.01135 inches thick and formed from 304 stainless steel. The metal screen is about 35 mesh, which is about 500 microns. In other words, anything smaller than 500 microns will pass through this 35 mesh filter element; anything larger than 500 microns will not pass through the metal mesh. The 35 mesh filter element is suitable for non-stabilized crude and/or condensate from the Eagle Ford Shale formation in Texas and perhaps elsewhere. A larger or smaller sized screen may be suitable for use in this invention depending on the location, application and degree of debris in the pipeline. Both of the filter elements 166 and 168 are disk-shaped having an upper surface 162 and a lower surface 164, better seen in FIGS. 8 and 10.

The inlet check valve assembly 190 is in the closed position in FIG. 8 and in the open position in FIG. 10. The inlet check valve assembly 190 includes an o-ring 240 which seals the inlet check valve assembly 190 against the housing 108. The inlet check valve assembly 190 further includes a movable cartridge valve 242, a metal seal 244 and a spring 246 which urges the movable cartridge valve 242 into the closed position as shown in FIG. 8. The inlet check valve assembly 190 is an off the shelf cartridge check valve model number 2203D-18-10 available from Kepner Products Company located in Villa Park, Ill.; the website is www.kepner.com. The outlet check valve assembly 192 is the same product from Kepner Products Company.

Figure 9:
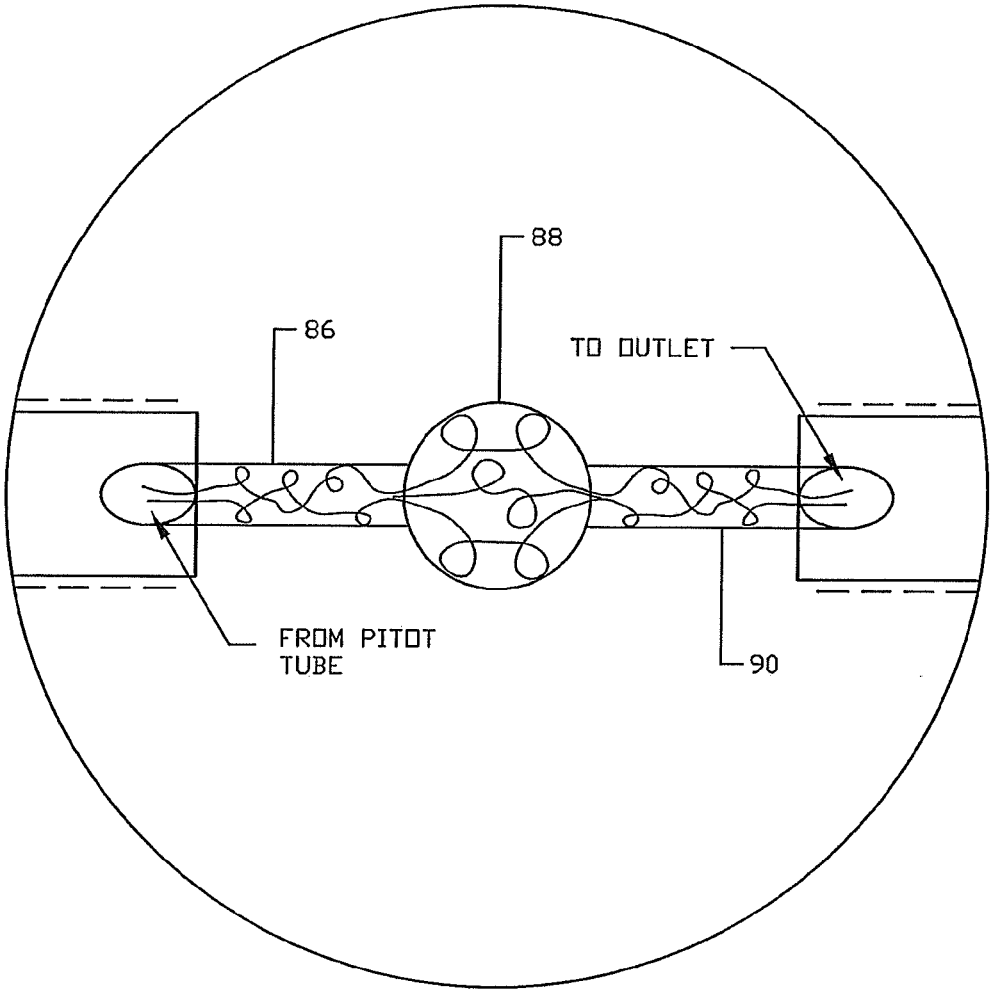
FIG. 9 is a section view along the line 9-9 of FIG. 8. The turbulent liquid is indicated by the swirling lines.

FIG. 9 is a section view along the line 9-9 of FIG. 8. The swirled lines indicate the turbulent liquid flow through the angled inlet passageway 86 and the agitation chamber 88 to the angled outlet passageway 90.

Figure 12:
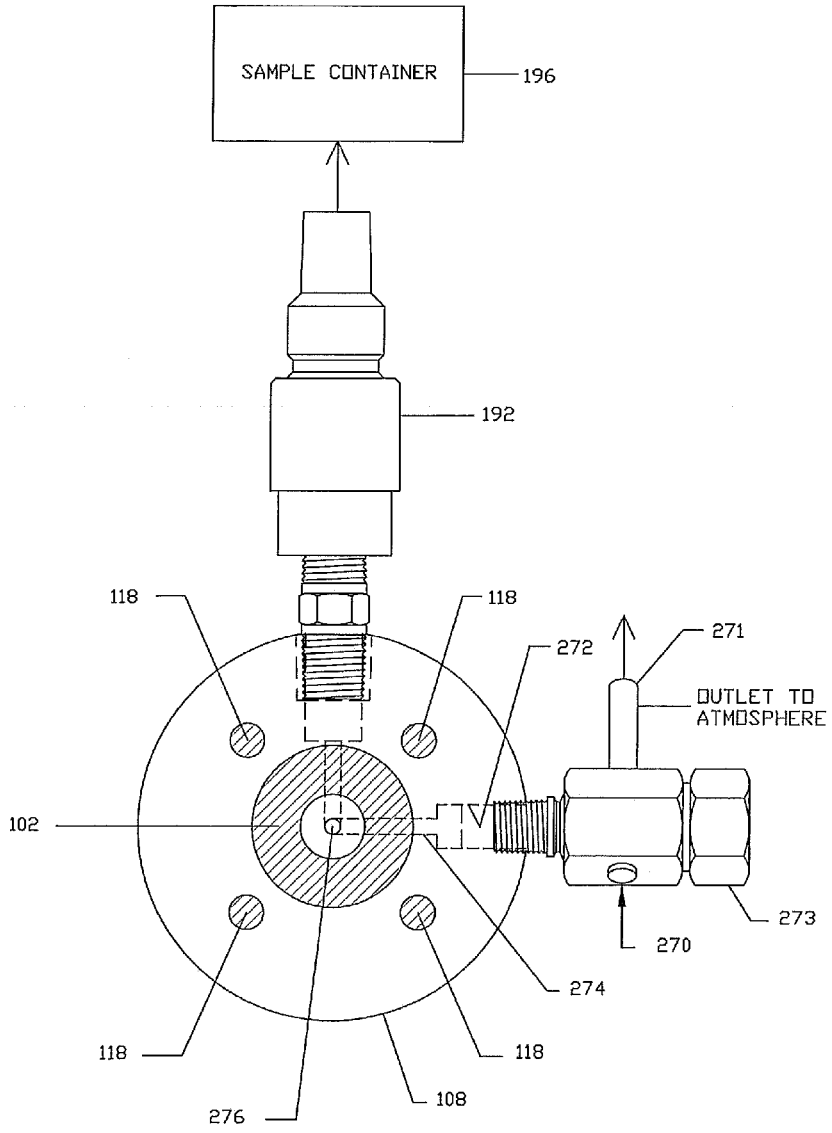
FIG. 12 is a view along the line 12-12 of FIG. 2.

FIG. 10 is similar to FIG. 8, except the inlet check valve assembly 190 is in the open position and the liquid sample is flowing from the agitation chamber 88 of the continuous liquid flow passageway 152 through the central opening 233 in the metallic washer 232, through apertures 250 of the movable cartridge valve 242 of the inlet check valve assembly 190 and out the sample outlet 194 to the sample container 196, best seen in FIG. 12.

Figure 11:
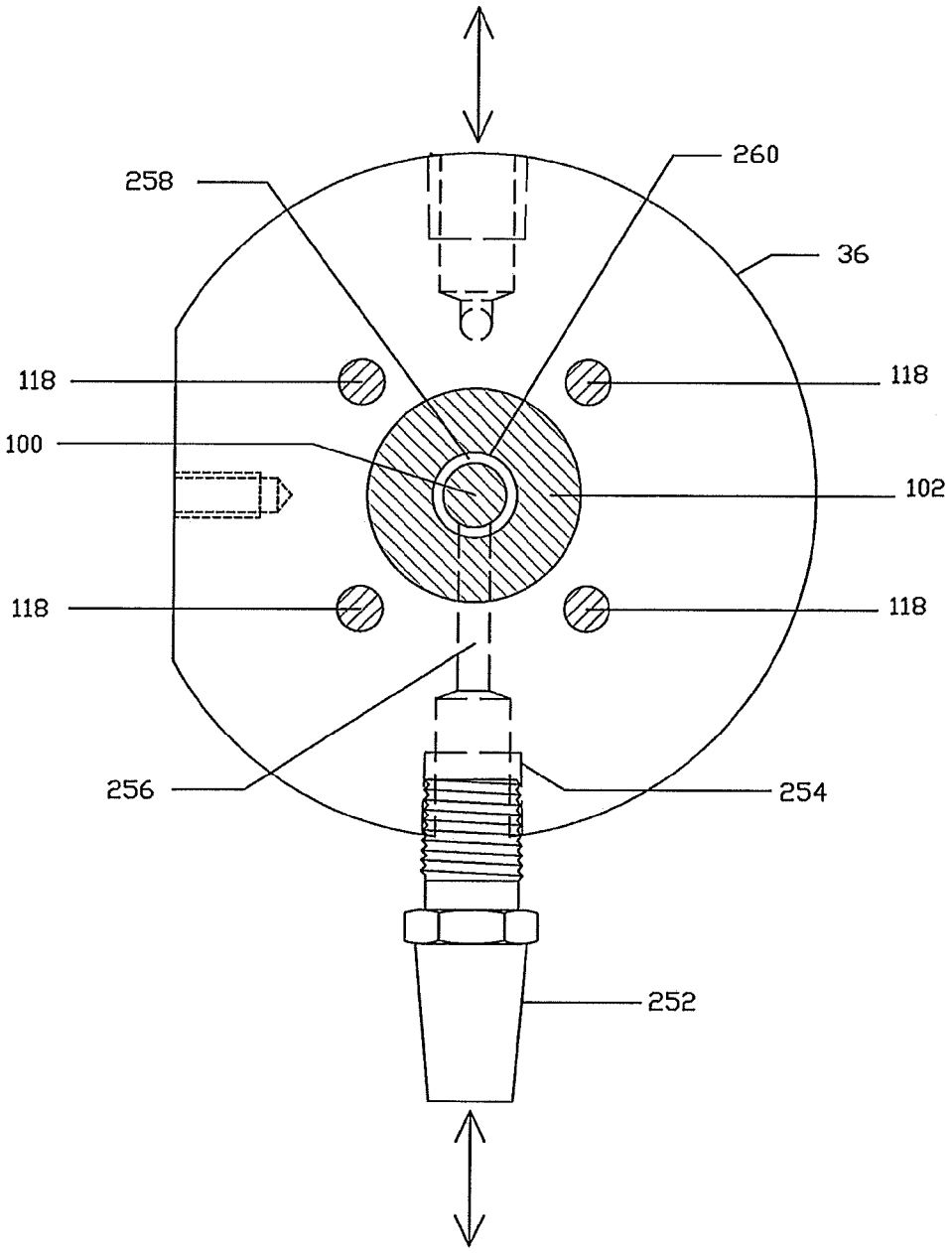
FIG. 11 is a view along the line 11-11 of FIG. 2.

FIG. 11 is a section view along the line 11-11 of FIG. 2. A muffler assembly 252 threadably engages a muffler port 254. The muffler assembly 252 is an off-the-shelf item, model number 4450K1, produced by McMaster Carr in Atlanta, Ga.; website www.mcmaster.com. The muffler port 254 connects to a passageway 256 which connect to the annulus 258 formed between the outside circumference of the elongate piston rod 100 and the inside circumference 260 of the lower cylinder 102. The muffler assembly 252 allows air to escape to atmosphere from the annulus 258 as the elongate piston rod 100 strokes up and allows air to be drawn into the annulus 258 as the elongate piston rod 100 strokes down. The muffler assembly 252 also prevents insects from entering the annulus 258 and building obstructive homes in the liquid sample pump with integral self-cleaning filter 20.

FIG. 12 is a section view along the line 12-12 of FIG. 2. A bleed valve assembly is generally identified by the numeral 270; the bleed valve assembly 270 threadably engages a bleed valve port 272 which is in fluid communication with a passageway 274 which is in fluid communication with the sample passage 276. The purpose of the bleed valve assembly 270 is to bleed air out of the sample passage 276 and the other passageways that conduct the liquid sample, including the continuous liquid flow passageway 152. The liquid sample pump 20 does not work well until all of the air is bled from the liquid sample pump 20. To bleed the air, the hex nut 273 on the end of the bleed valve is turned and air exits the air outlet 271 to atmosphere as indicated by the flow arrow. The bleed valve assembly 270 is an off-the-shelf item, model no. SS-BVM2, ⅛ inch NPT from Swagelok; the headquarters are located in Solon, Ohio, and distribution is throughout the U.S. The website is www.swagelok.com.

Figure 13:
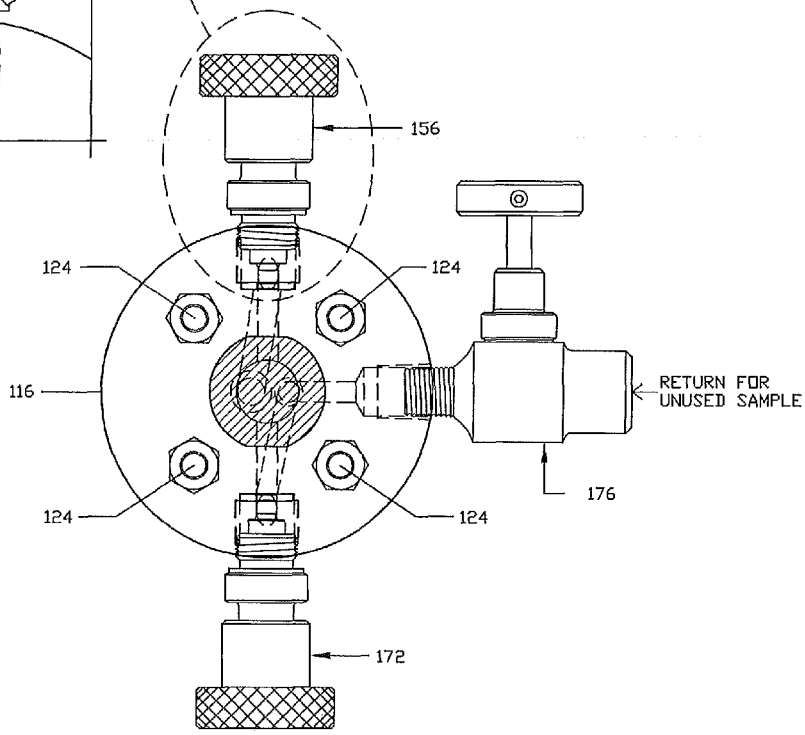
FIG. 13 is a view along the line 13-13 of FIG. 2.

FIG. 13 is a section view along the line 13-13 of FIG. 2. The inlet on/off valve assembly 156 is shown in the 12 o'clock position, and the outlet on/off valve assembly 172 is shown in the six o'clock position. A third valve assembly 176 is shown in the three o'clock position in the drawing. The third valve may be used to return any unwanted sample to the pipeline 70. Sample is typically collected in a pre-pressurized cylinder. The pre-pressurized cylinder allows unused sample to be returned against pipeline pressure through the third valve assembly 176.

Figure 14:
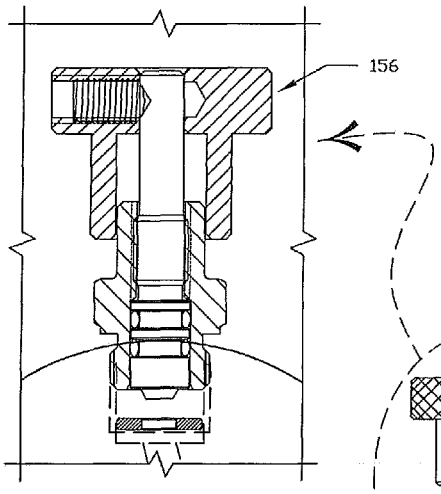
FIG. 14 is a section view of the inlet on/off valve in the open position.

FIG. 14 is an enlargement of the outlet on/off valve assembly 172 and identical to the inlet on/off valve assembly 156. These on/off valve assemblies are normally in the open position, as shown in this figure, so the liquid can flow through the hot loop. These valve assemblies are shifted to the closed position only to maintain the liquid sample pump 20.

Figure 15:
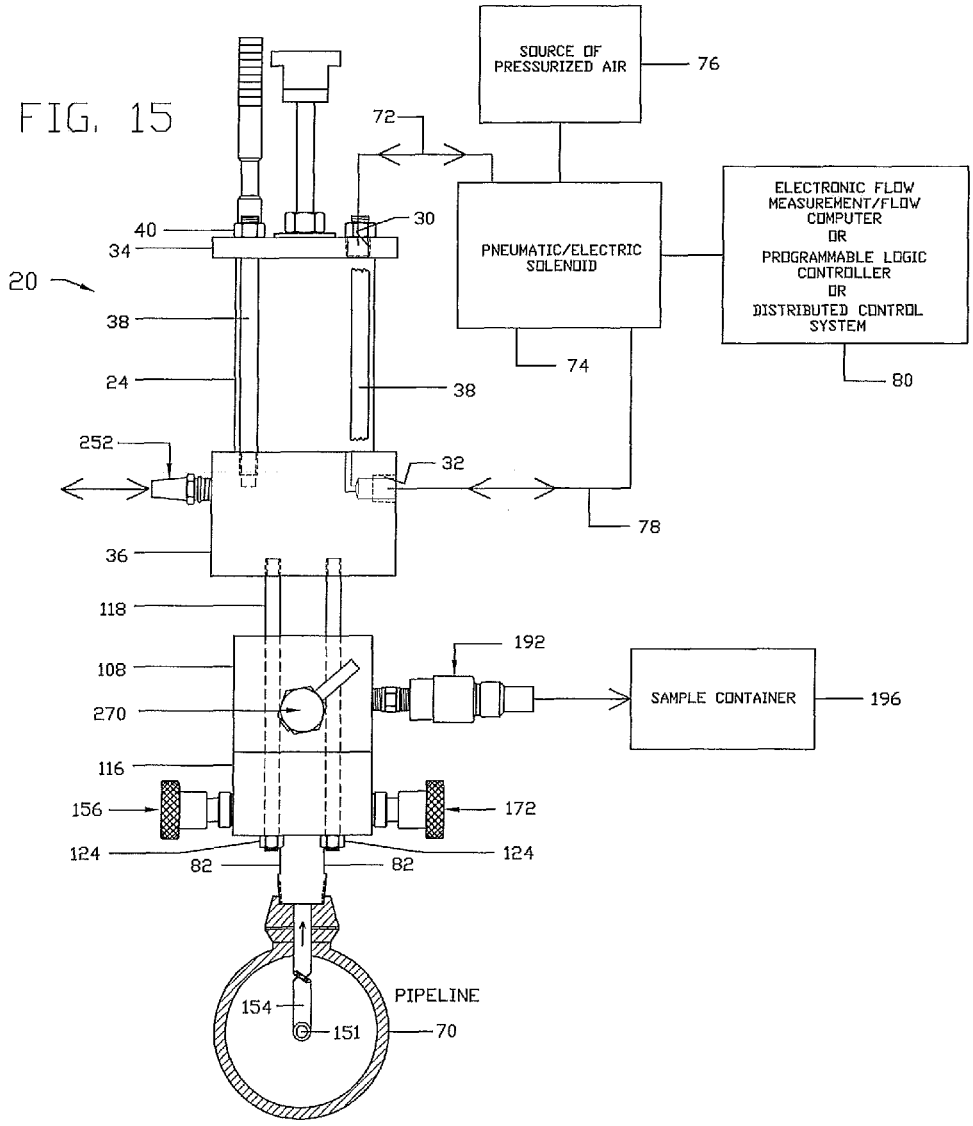
FIG. 15 is a section view of the sample pump with integral self-cleaning filter element and related equipment shown by block diagram. This version of the invention threads into a thread-o-let welded to the pipeline. This is an accurate view of the apparatus, unlike some of the prior figures that were for illustrative purposes.

FIG. 15 is a block diagram showing a true side view of the liquid sample pump with integral self-cleaning filter 20 and associated equipment. This view of the liquid sample pump 20 has not been altered for illustrative purposes. This version of the liquid sample pump 20 has a threaded neck which threads into a thread-o-let in the pipeline 70. The outlet check valve assembly 192 is typically connected either directly to a sample container 196 or indirectly connected by tubing to the sample container 196. This perspective view shows how the apparatus is held together by the tie rods 38 and the nuts 40, tie rods 118 and the nuts 124. When it is necessary to replace the filter element 160, an operator turns the hot loop off by closing the inlet on/off valve assembly 156 and outlet on/off valve assembly 172. The operator then removes the nuts 124 which will allow separation of the housing 108 and the lower end cap 116. The filter element 160 may then easily be removed and replaced. If necessary, the seals, o-rings and wipers on the end of the elongate piston rod 100 may also be removed and replaced. The sample pump is reassembled and the on/off valve assemblies are opened, which reopens the hot loop. The operator then opens the bleed valve assembly 270 to bleed air from the sample pump, and then closes the bleed valve assembly. The sample pump is then ready to take new samples.

FIG. 16 is a true side view of an alternative embodiment of the liquid sample pump with integral self-cleaning filter 20. This view of the liquid sample pump 20 has not been altered for illustrative purposes. A bottom flange 280 is mounted on the pipeline 70. An upper flange 282 mates with the bottom flange 280 on the pipeline 70; both flanges are held together with nuts 284 and bolts 286, as is well known to those skilled in the art. A neck 288 is typically welded to the upper flange 282; the neck 288 supports the sample pump with integral self-cleaning filter 20. Some customers prefer flanged connections and some prefer thread-o-let connections; therefore the sample pump with integral self-cleaning filter 20 is offered in two different versions by the assignee.

The invention claimed is:

1. In combination, a liquid sample pump with a self-cleaning filter element operatively connected to a liquid pipeline, the combination comprising:

means for stroking a piston up and down in an upper cylinder;

an elongate piston rod having a first end operatively connected to the piston and a second end carrying seal means to seal against an inside circumferential surface of a lower cylinder surrounding a portion of the elongate piston rod;

a variable volume sample chamber defined by: (1) the second end of the elongate piston rod, (2) the inside circumferential surface of the lower cylinder, and (3) a housing;

a lower end cap removably connected to the housing;

a removable self-cleaning filter element trapped between the lower end cap and the housing, the self-cleaning filter element defining an upper surface and a lower surface;

an inlet in fluid communication with a liquid flow in the pipeline and a liquid flow passageway;

the liquid flow passageway in fluid communication with an agitation chamber for turbulent liquid located proximate the lower surface of the self-cleaning filter element to remove debris from the lower surface of the self-cleaning filter element;

an outlet in fluid communication with the liquid flow passageway to return liquid and debris back to the liquid flow in the pipeline, the outlet being downstream of the inlet;

a single neck engaged with the pipeline, wherein said inlet and outlet extend into the pipeline through the neck; and the inlet, the liquid flow passageway, the agitation chamber and the outlet defining a continuously flowing stream of liquid wherein said liquid flow passageway is structured and oriented to create the turbulent liquid below the filter element.

2. The combination of claim 1 further including:

an inlet check valve positioned between the self-cleaning filter element and the variable volume sample chamber;

an outlet check valve positioned between the variable volume sample chamber and a sample container;

the inlet check valve opening when the elongate piston rod strokes up, allowing fresh sample to pass through the self-cleaning filter element into the variable volume sample chamber and the outlet check valve closing to isolate the sample container; and the inlet check valve closing when the elongate piston rod strokes down, and the outlet check valve opening to pump fresh sample from the variable volume sample chamber to the sample container.

3. The combination of claim 2 wherein the self-cleaning filter element is formed from a sintered metal.

4. The combination of claim 3 wherein the sintered metal filter element is circular and disk-shaped.

5. The combination of claim 4 further including:

means for adjusting the volume in the variable volume sample chamber.

6. The combination of claim 2 wherein the self-cleaning filter element is formed of a metal mesh screen.

7. The combination of claim 6 wherein the metal mesh screen is circular and disk-shaped.

8. The combination of claim 7 further including:

means for adjusting the volume in the variable volume sample chamber.

9. In combination, a liquid sample pump and a self-cleaning filter element comprising:

means for varying the volume in a variable volume sample chamber;

means for stroking a piston up and down in the variable volume sample chamber; and a liquid flow passageway including an agitation chamber for turbulent liquid positioned below a lower surface of the self-cleaning filter element to remove debris from the filter element and the liquid sample pump;

wherein said liquid flow passageway is structured and oriented to create the turbulent liquid below the filter element.

10. The combination of claim 9, further including:

an inlet check valve and an outlet check valve, the inlet check valve being in the open position when sample is drawn into the variable volume sample chamber and the inlet check valve being closed when sample is pumped into a sample container.

11. The combination of claim 10 further wherein: the self-cleaning filter element if formed from sintered metal and is circular and disk-shaped.

12. The combination of claim 10 wherein: the self-cleaning filter element if formed from metal mesh and is circular and disk-shaped.

13. In combination, a liquid sample pump and a self-cleaning filter element comprising:

means for stroking a piston up and down in the variable volume sample chamber; and means for creating a hot loop of liquid including an agitation chamber adjacent the lower surface of the self-cleaning filter element to remove debris from the self-cleaning filter element;

wherein said hot loop is structured and oriented to create the turbulent liquid below the filter element.

14. The combination of claim 13 further including:

means for adjusting the volume in a variable volume sample chamber.

15. The combination of claim 13 wherein an inlet and an outlet of the hot loop extend into a pipeline through a single neck of the liquid sample pump, said neck being engaged with a port in the pipeline.

* * * * *